US012114785B2

(12) United States Patent
Patterson

(10) Patent No.: US 12,114,785 B2
(45) Date of Patent: Oct. 15, 2024

(54) DISPOSABLE SEAT BLANKET ASSEMBLY

(71) Applicant: Shirley Patterson, Cerritos, CA (US)

(72) Inventor: Shirley Patterson, Cerritos, CA (US)

( * ) Notice: Subject to any disclaimer, the term of this patent is extended or adjusted under 35 U.S.C. 154(b) by 103 days.

(21) Appl. No.: 18/082,246

(22) Filed: Dec. 15, 2022

(65) Prior Publication Data

US 2024/0197080 A1 Jun. 20, 2024

(51) Int. Cl.
*A47C 31/11* (2006.01)

(52) U.S. Cl.
CPC ..... *A47C 31/11* (2013.01)

(58) Field of Classification Search
CPC ..... A47C 31/10; A47C 31/11; B60N 2/60
USPC ..... 297/228.1, 219.1
See application file for complete search history.

(56) References Cited

U.S. PATENT DOCUMENTS 3,101,037 A * 8/1963 Taylor ..... B60N 2/5883 297/452.47
3,102,755 A * 9/1963 Wilfert ..... B60N 2/5825 297/229
3,884,355 A * 5/1975 Eriksson ..... B60N 2/60 206/526
4,313,640 A * 2/1982 Trotman ..... A47C 7/742 297/452.45
4,457,032 A * 7/1984 Clarke ..... B60N 2/60 297/382
4,676,376 A * 6/1987 Keiswetter ..... B60N 2/60 297/229
6,616,225 B2 * 9/2003 Graff ..... A47C 1/14 297/229
6,948,771 B1 * 9/2005 Salandy ..... A47C 31/11 297/228.11
7,517,013 B1 * 4/2009 Lowe ..... A47C 7/742 297/188.2
7,591,033 B2 * 9/2009 Theriault ..... A47C 31/11 5/419
9,302,603 B1 * 4/2016 Knight ..... B60N 2/60
9,845,034 B1 12/2017 Lew
10,336,227 B1 * 7/2019 Weiss ..... B60N 2/6036
10,342,360 B2 7/2019 Calhoun
D939,250 S 12/2021 Cochran
2003/0106157 A1 * 6/2003 Rugset ..... A47C 31/10 5/737
2008/0231096 A1 * 9/2008 Romero ..... A47C 31/11 297/219.1
2008/0303333 A1 12/2008 Cucuras
(Continued)

FOREIGN PATENT DOCUMENTS

WO WO2018026732 2/2018

*Primary Examiner* — Jose V Chen

(57) ABSTRACT

A disposable seat blanket assembly includes a blanket that has a top layer which is comprised of a deformable material and a bottom layer which is comprised of a fluid impermeable material. The bottom layer is positionable on a seat in a public transportation vehicle thereby facilitating a user to sit on the top layer. In this way the bottom layer protects the user from germs on the seat. The blanket has a plurality of fold lines integrated into the blanket thereby facilitating the blanket to be folded for disposal when the user is finished sitting on the blanket. A pouch is provided and the pouch is comprised of a fluid impermeable material. The blanket is insertable into the pouch when the blanket is folded for disposal.

7 Claims, 4 Drawing Sheets

(56) References Cited

U.S. PATENT DOCUMENTS

| | | | | |
|---|---|---|---|---|
| 2009/0091165 | A1* | 4/2009 | Thompson | B60N 2/6009 297/228.12 |
| 2009/0284056 | A1 | 11/2009 | Chico | |
| 2011/0198895 | A1* | 8/2011 | Friedman | A47C 1/14 5/636 |
| 2013/0187415 | A1* | 7/2013 | Shelley | A47C 31/11 297/228.11 |
| 2013/0320720 | A1 | 12/2013 | Steinmetz | |
| 2015/0283930 | A1* | 10/2015 | Dayton | B60N 2/60 297/220 |
| 2016/0088949 | A1* | 3/2016 | Yakubyak | B60R 11/0247 297/229 |
| 2016/0129819 | A1* | 5/2016 | Johnson, Jr. | B60N 2/5891 297/219.1 |
| 2016/0316931 | A1 | 11/2016 | Trevino | |
| 2016/0338502 | A1* | 11/2016 | Markowitz | A47C 31/11 |
| 2019/0016243 | A1* | 1/2019 | Pancol | B60N 2/60 |
| 2019/0261781 | A1* | 8/2019 | Hoensheid | A45C 13/103 |
| 2019/0389347 | A1* | 12/2019 | Francescatto | B60N 2/60 |
| 2020/0290491 | A1* | 9/2020 | Mohr | B60N 2/6018 |
| 2021/0267332 | A1* | 9/2021 | Gies | A47C 7/386 |
| 2022/0242288 | A1* | 8/2022 | Po-Jung | B60N 2/60 |
| 2023/0320493 | A1* | 10/2023 | Skochenski | A47C 31/113 297/219.1 |

* cited by examiner

DISPOSABLE SEAT BLANKET ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to disposable blanket devices and more particularly pertains to a new disposable blanket device for positioning on a seat in a public transportation vehicle to protect a user from germs on the seat. The device includes a blanket which has a top layer of deformable textile and a bottom layer of a fluid impermeable material. The blanket is positioned on the seat such that the bottom layer rests on the seat. The blanket has a plurality of fold lines for folding the blanket for disposal. The device includes a pouch for receiving the blanket when the blanket has been folded for disposal.

(2) Description of Related Art Including Information Disclosed Under 37 CFR 1.97 and 1.98

The prior art relates to disposable blanket devices including a seat cover that has a pair of arm rest sleeves each extending laterally away from the seat cover. The prior art discloses a modular seat cover that includes a chair portion and a pair of arm rest panels that are attachable to the chair portion. The prior art discloses a seat cover that includes a headrest cover and a panel extending away from the headrest cover. The prior art discloses a seat cover that has a back rest cover and a pair of lobes each extending away from the back rest cover. The prior art discloses a headrest cover for a seat comprising a form fitting cover for a headrest of a seat. The prior art discloses an ornamental design for a seat cover that includes a panel and a tab extending away from the panel.

BRIEF SUMMARY OF THE INVENTION

An embodiment of the disclosure meets the needs presented above by generally comprising a blanket that has a top layer which is comprised of a deformable material and a bottom layer which is comprised of a fluid impermeable material. The bottom layer is positionable on a seat in a public transportation vehicle thereby facilitating a user to sit on the top layer. In this way the bottom layer protects the user from germs on the seat. The blanket has a plurality of fold lines integrated into the blanket thereby facilitating the blanket to be folded for disposal when the user is finished sitting on the blanket. A pouch is provided and the pouch is comprised of a fluid impermeable material. The blanket is insertable into the pouch when the blanket is folded for disposal.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
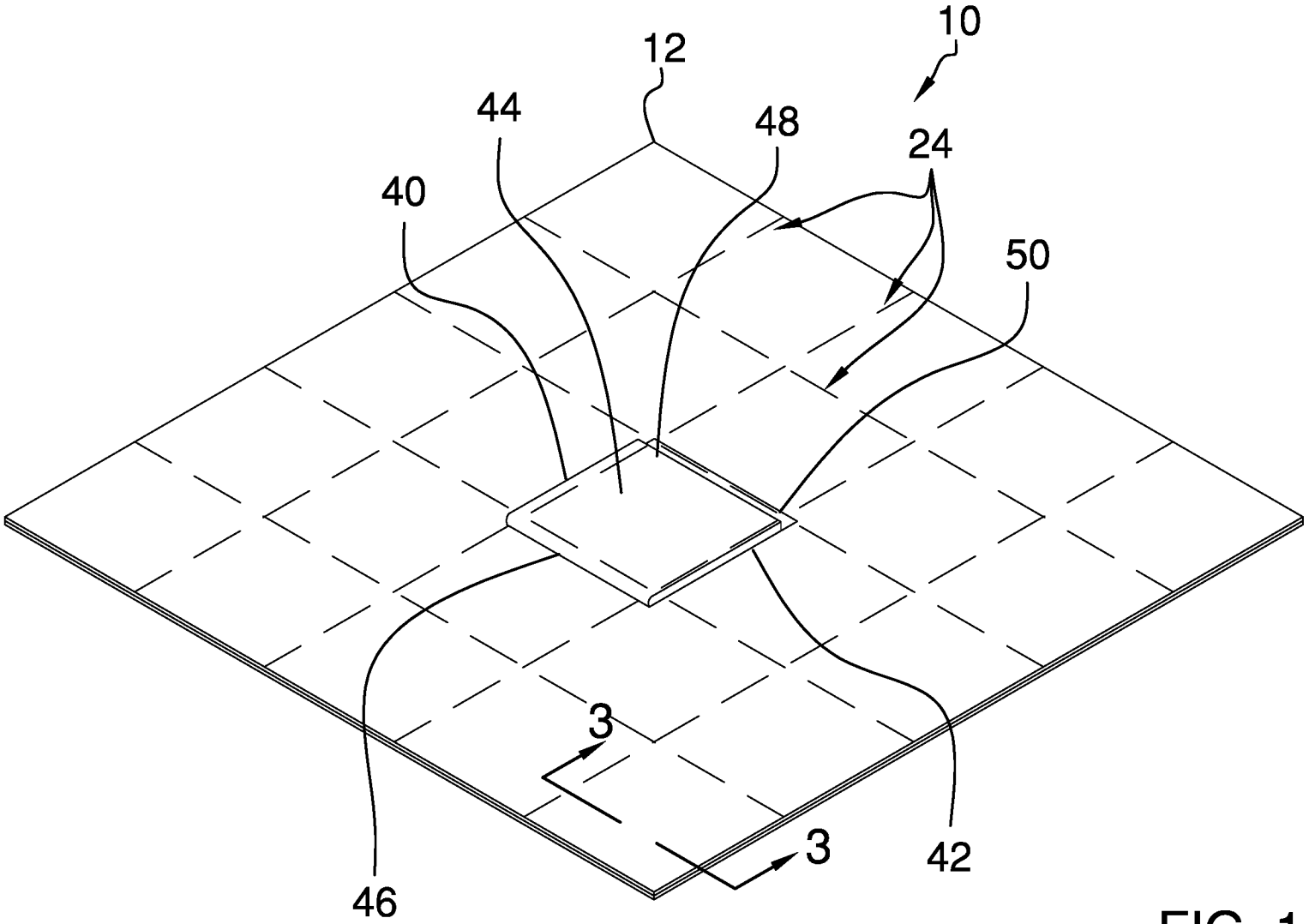
FIG. 1 is a top perspective view of a disposable seat blanket assembly according to an embodiment of the disclosure.

With reference now to the drawings, and in particular to FIGS. 1 through 4 thereof, a new disposable blanket device embodying the principles and concepts of an embodiment of the disclosure and generally designated by the reference numeral 10 will be described.

As best illustrated in FIGS. 1 through 4, the disposable seat blanket assembly 10 generally comprises a blanket 12 that has a top layer 14 which is comprised of a deformable material and a bottom layer 16 which is comprised of a fluid impermeable material. The deformable material may include but not be limited to a microfiber textile or other type of fabric. The fluid impermeable material may include but not be limited to a biodegradable plastic or other similar type of material. The bottom layer 16 is positionable on a seat 18 in a public transportation vehicle 20 thereby facilitating a user 22 to sit on the top layer 14. In this way the bottom layer 16 protects the user 22 from being exposed to germs on the seat 18. Furthermore, the blanket 12 has a plurality of fold lines 24 integrated into the blanket 12 thereby facilitating the blanket 12 to be folded for disposal when the user 22 is finished sitting on the blanket 12.

The blanket 12 has a perimeter edge 26 that has a top side 28, a bottom side 30, a first lateral side 32 and a second lateral side 34. The plurality of fold lines 24 includes a set of first fold lines 36 each extending between the top side 28 and the bottom side 30. The first fold lines 36 are spaced apart from each other and are evenly distributed between the first lateral side 32 and the second lateral side 34. The plurality of fold lines 24 includes a set of second fold lines 38 each extending between the first lateral side 32 and the second lateral side 34. The second fold lines 38 are spaced apart from each other and are evenly distributed between the top side 28 and the bottom side 30. The blanket 12 is foldable along each of the first fold lines 36 and the second fold lines 38 such that the blanket 12 is folded into a square. The first fold lines 36 may be spaced approximately 10.0 cm from each other and the second fold lines 38 may be spaced approximately 10.0 cm from each other. Furthermore, the blanket 12 may have a length of approximately 50.0 cm and a width of approximately 50.0 cm.

A pouch 40 is provided which is comprised of a fluid impermeable material. The fluid impermeable material associated with the pouch 40 may comprise a biodegradable plastic or other similar type of material. Additionally, the blanket 12 is insertable into the pouch 40 when the blanket 12 is folded for disposal. The pouch 40 has a back wall 42, a front wall 44 and a perimeter edge 46 extending through the back wall 42 and the front wall 44. The perimeter edge 46 of the pouch 40 has an upper side 48 and the upper side 48 is open into an interior of the pouch 40. The back wall 42 extends upwardly beyond the upper side 48 to define a flap 50 that is foldable over the upper side 48 when the blanket 12 is inserted into the pouch 40 for closing the pouch 40.

Figure 2:
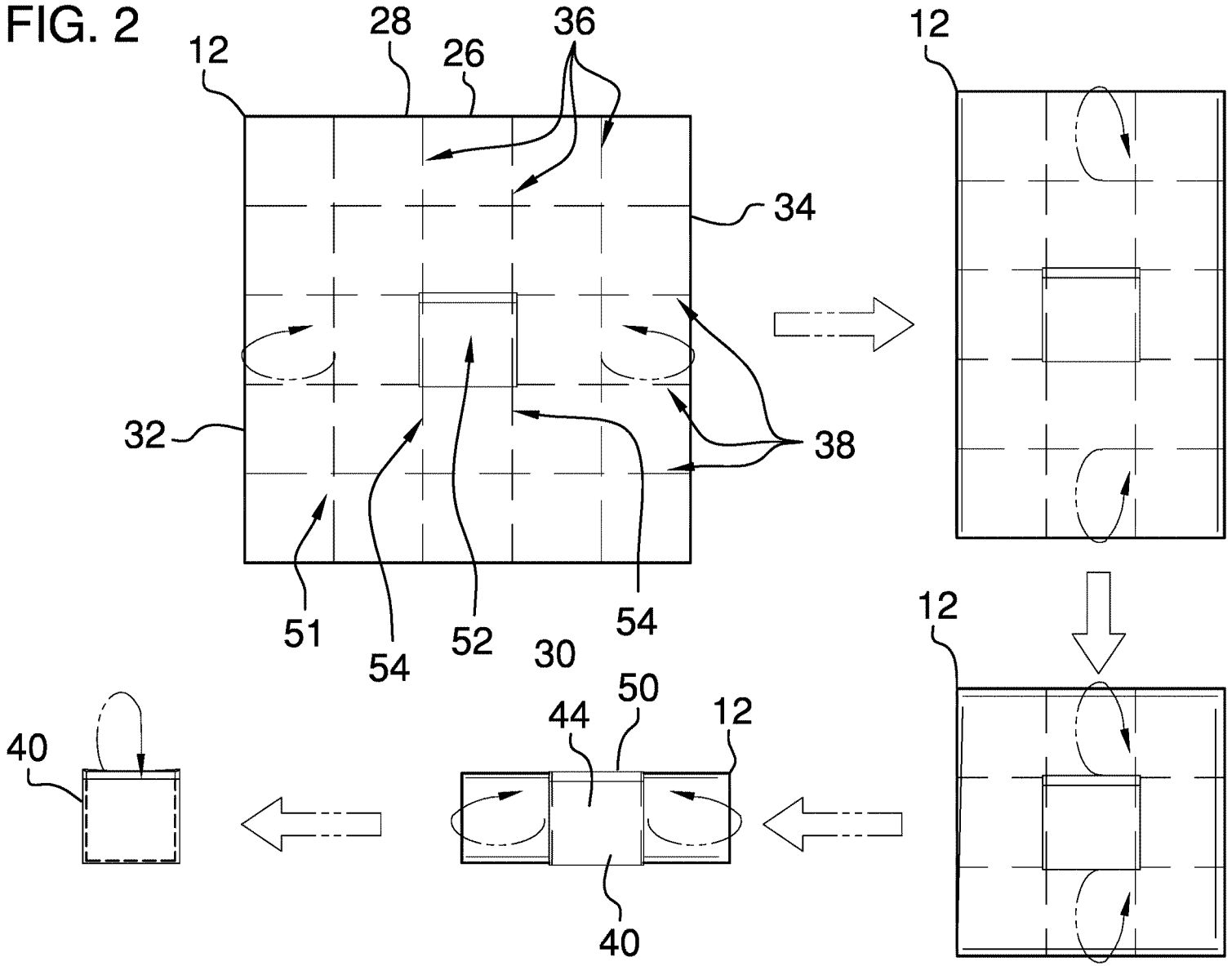
FIG. 2 is a perspective view of an embodiment of the disclosure showing a blanket being folded along fold lines in the blanket.
Figure 3:
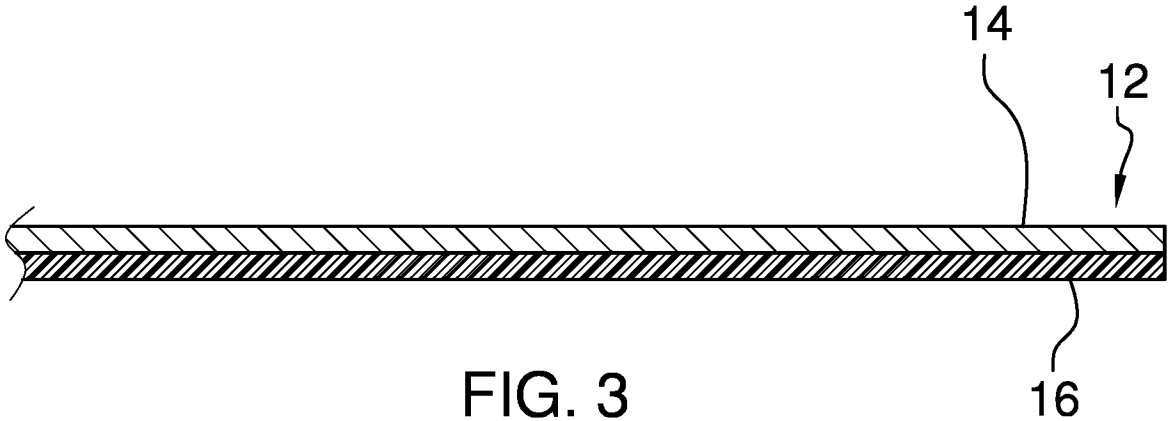
FIG. 3 is a cross sectional view taken along line 3-3 of FIG. 1 of an embodiment of the disclosure.
Figure 4:
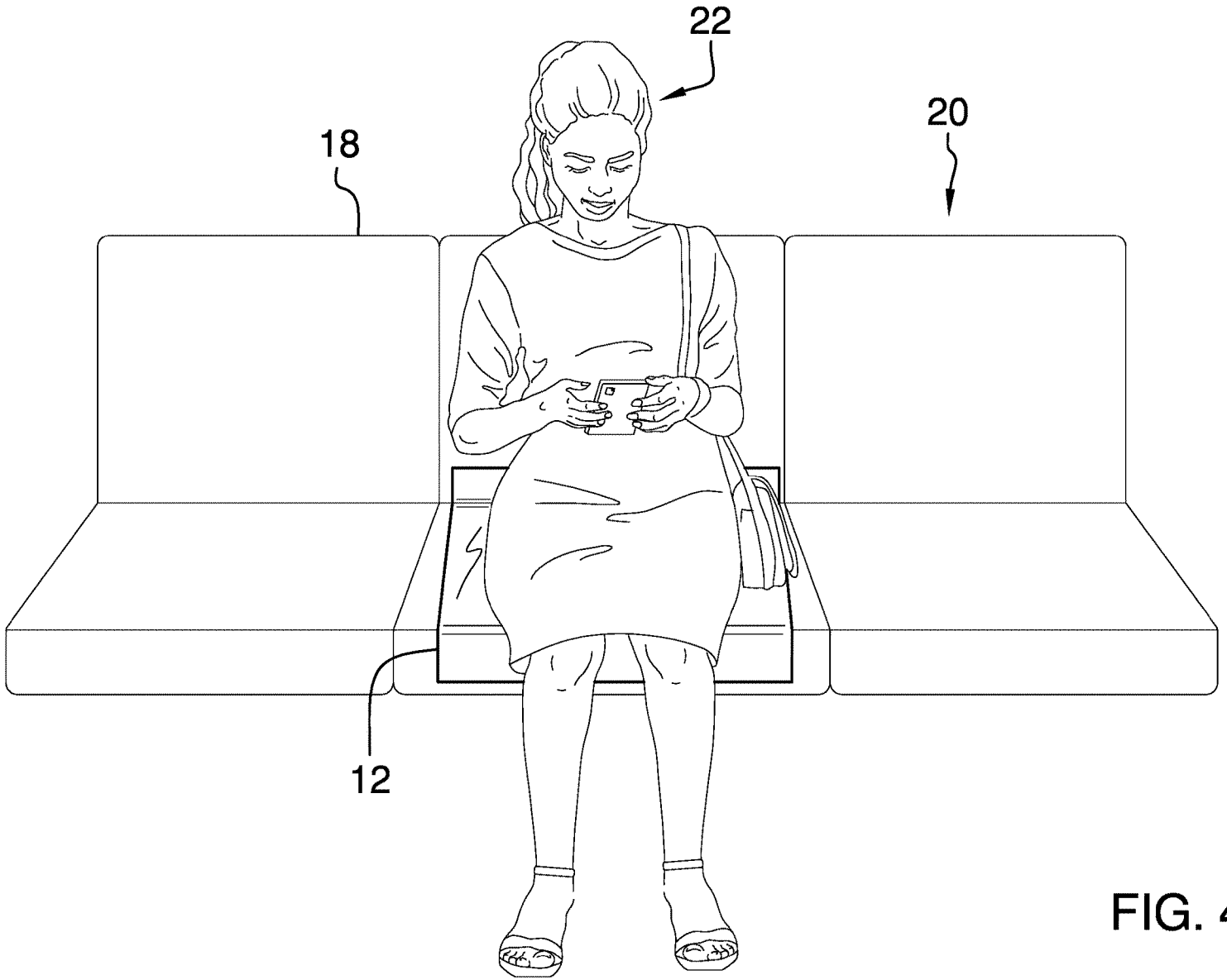
FIG. 4 is a perspective in-use view of an embodiment of the disclosure.

As is most clearly shown in FIGS. 1 and 2, the plurality of fold lines 24 on the blanket 12 defines a grid 51 that has a central square 52 which is centrally located on the blanket 12. The back wall 42 of the pouch 40 may be bonded to the top layer 14 of the blanket 12. Furthermore, the pouch 40 may be located on the central square 52 defined by the grid 51. The blanket 12 may have a plurality of cuts 54 each extending through the top layer 14 and the bottom layer 16. Furthermore, the plurality of cuts 54 may strategically positioned with respect to the pouch 40 to facilitate the blanket 12 to be folded into the pouch 40 for disposal.

In use, the blanket 12 is unfolded and the blanket 12 is placed on the seat 18 on the public transportation vehicle 20 such that the bottom layer 16 rests on the seat 18. In this way the user 22 can sit on the top layer 14 of the blanket 12 while the bottom layer 16 protects the user 22 from germs on the seat 18. In this way the user 22 can travel on public transportation without coming into contact with germs on the seat 18. The blanket 12 is folded along each of the fold lines 24 when the user 22 is finished riding on the public transportation and the blanket 12 is inserted into the pouch 40 for disposal.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A disposable seat blanket assembly for facilitating a user to protect themselves from germs on a seat in a public transportation vehicle, said assembly comprising:

a blanket having a top layer being comprised of a deformable material and a bottom layer being comprised of a fluid impermeable material, said bottom layer being positionable on a seat in a public transportation vehicle thereby facilitating a user to sit on said top layer wherein said bottom layer is configured to protect the user from germs on the seat, said blanket having a plurality of fold lines being integrated into said blanket thereby facilitating said blanket to be folded for disposal when the user is finished sitting on said blanket;

a pouch being comprised of a fluid impermeable material, said blanket being insertable into said pouch when said blanket is folded for disposal;

wherein said blanket has a perimeter edge having a top side and a bottom side and a first lateral side and a second lateral side;

wherein said plurality of fold lines includes a set of first fold lines each extending between said top side and said bottom side, said first fold lines being spaced apart from each other and being evenly distributed between said first lateral side and said second lateral side; and wherein said plurality of fold lines includes a set of second fold lines each extending between said first lateral side and said second lateral side, said second fold lines being spaced apart from each other and being evenly distributed between said top side and said bottom side.

2. The assembly according to claim 1, further comprising said blanket being foldable along each of said first fold lines and said second fold lines such that said blanket is folded into a square.

3. A disposable seat blanket assembly for facilitating a user to protect themselves from germs on a seat in a public transportation vehicle, said assembly comprising:

a blanket having a top layer being comprised of a deformable material and a bottom layer being comprised of a fluid impermeable material, said bottom layer being positionable on a seat in a public transportation vehicle thereby facilitating a user to sit on said top layer wherein said bottom layer is configured to protect the user from germs on the seat, said blanket having a plurality of fold lines being integrated into said blanket thereby facilitating said blanket to be folded for disposal when the user is finished sitting on said blanket;

a pouch being comprised of a fluid impermeable material, said blanket being insertable into said pouch when said blanket is folded for disposal; and wherein said pouch has a back wall, a front wall and a perimeter edge extending through said back wall and said front wall, said perimeter edge of said pouch having an upper side, said upper side being open into an interior of said pouch, said back wall extending upwardly beyond said upper side to define a flap being foldable over said upper side when said blanket is inserted into said pouch for closing said pouch.

4. A disposable seat blanket assembly for facilitating a user to protect themselves from germs on a seat in a public transportation vehicle, said assembly comprising:

a blanket having a top layer being comprised of a deformable material and a bottom layer being comprised of a fluid impermeable material, said bottom layer being positionable on a seat in a public transportation vehicle thereby facilitating a user to sit on said top layer wherein said bottom layer is configured to protect the user from germs on the seat, said blanket having a plurality of fold lines being integrated into said blanket thereby facilitating said blanket to be folded for disposal when the user is finished sitting on said blanket, said blanket having a perimeter edge having a top side and a bottom side and a first lateral side and a second lateral side, said plurality of fold lines including a set of first fold lines each extending between said top side and said bottom side, said first fold lines being spaced apart from each other and being evenly distributed between said first lateral side and said second lateral side, said plurality of fold lines including a set of second fold lines each extending between said first lateral side and said second lateral side, said second fold lines being spaced apart from each other and being evenly distributed between said top side and said bottom side, said blanket being foldable along each of said first fold lines and said second fold lines such that said blanket is folded into a square; and a pouch being comprised of a fluid impermeable material, said blanket being insertable into said pouch when said blanket is folded for disposal, said pouch having a back wall, a front wall and a perimeter edge extending through said back wall and said front wall, said perimeter edge of said pouch having an upper side, said upper side being open into an interior of said pouch, said back wall extending upwardly beyond said upper side to define a flap being foldable over said upper side when said blanket is inserted into said pouch for closing said pouch.

5. The assembly according to claim 2, wherein said plurality of fold lines on said blanket defines a grid having a central square being centrally located on said blanket.

6. The assembly according to claim 5, wherein said back wall of said pouch is bonded to said top layer of said blanket having said pouch being located on said central square defined by said grid.

7. The assembly according to claim 6, wherein said blanket has a plurality of cuts each extending through said top layer and said bottom layer, said plurality of cuts being strategically positioned with respect to said pouch to facilitate said blanket to be folded into said pouch for disposal.

* * * * *